US006000412A

United States Patent [19]

Chan et al.

[11] Patent Number: 6,000,412

[45] Date of Patent: Dec. 14, 1999

[54] METHOD FOR CLEANING DEPOSITS FROM A TANK USING A SURFACTANT COMPOSITION

[75] Inventors: Albert F. Chan, Plano, Tex.; William Mark Bohon; David J. Blumer, both of Anchorage, Ak.; Kieu T. Ly, Richardson, Tex.; William G. McLelland, Chugiak, Ak.

[73] Assignee: Atlantic Richfield Company, Los Angeles, Calif.

[21] Appl. No.: 09/023,379

[22] Filed: Feb. 13, 1998

[51] Int. Cl.[6] ..... E21B 33/05

[52] U.S. Cl. ..... 134/22.14; 507/211

[58] Field of Search ..... 134/22.14; 507/211

[56] References Cited

U.S. PATENT DOCUMENTS

| | | | |
|---|---|---|---|
| 3,070,162 | 12/1962 | Barnard, Jr. | 166/38 |
| 3,400,017 | 9/1968 | Huebner et al. | 134/22.17 |
| 3,529,666 | 9/1970 | Crowe | 166/300 |
| 3,653,441 | 4/1972 | Tuttle | 166/291 |
| 3,756,319 | 9/1973 | Holm et al. | 166/304 |
| 3,884,302 | 5/1975 | Messenger | 166/291 |
| 4,423,781 | 1/1984 | Thomas | 166/312 |
| 4,439,241 | 3/1984 | Ault et al. | 134/22.14 |
| 4,528,106 | 7/1985 | Grolitzer | 252/8.55 D |
| 4,565,647 | 1/1986 | Llenado | 252/354 |
| 4,648,453 | 3/1987 | Nagra et al. | 166/281 |
| 4,681,164 | 7/1987 | Stacks | 166/304 |
| 4,856,589 | 8/1989 | Kuhlman et al. | 507/211 |
| 4,985,154 | 1/1991 | Balzer et al. | 507/211 |
| 5,030,366 | 7/1991 | Wilson et al. | 252/8.551 |
| 5,164,116 | 11/1992 | Berkhof et al. | 252/331 |
| 5,221,343 | 6/1993 | Grauer et al. | 106/729 |
| 5,374,361 | 12/1994 | Chan | 507/211 |
| 5,458,197 | 10/1995 | Chan | 166/304 |
| 5,466,746 | 11/1995 | Geck et al. | 524/837 |
| 5,627,144 | 5/1997 | Urfer et al. | 507/211 |
| 5,830,831 | 11/1998 | Chan et al. | 507/211 |

*Primary Examiner*—Jill Warden
*Assistant Examiner*—Yolanda E. Wilkins
*Attorney, Agent, or Firm*—F. Lindsey Scott

[57] ABSTRACT

A method for removing deposits of heavy hydrocarbonaceous materials and finely divided inorganic particulate matter from a tank using a composition containing an alkyl polyglycoside, an ethoxylated alcohol, a caustic and an alkyl alcohol.

20 Claims, 3 Drawing Sheets

METHOD FOR CLEANING DEPOSITS FROM A TANK USING A SURFACTANT COMPOSITION

BACKGROUND OF THE INVENTION

1. Field of the Invention

This invention relates to the removal of deposits comprising heavy hydrocarbonaceous materials and finely divided inorganic solids from a tank using an alkyl polyglycoside surfactant composition.

2. Background of the Invention

Mixtures of oil, gas and water are frequently produced from oil fields. Processes for treating such mixtures to produce separate streams of oil, gas and water are well known. Typically the oil is separated and recovered as a product; the gas may be separated and recovered as a product; or, alternatively, the gas may be injected into a gas cap above an oil-bearing zone, into an oil-bearing zone or the like as recovered or as a miscible injectant which comprises the produced gas adjusted by the addition of nitrogen, carbon dioxide, hydrocarbons containing from one to about five carbon atoms and the like to adjust the specific gravity of the miscible injectant. The water may be recovered for injection or disposal by other means as known to those skilled in the art.

The separation is frequently accomplished in large settling (separator) tanks where the oil, gas and water are allowed to gravimetrically separate.

In many instances, the mixture of oil, gas and water is passed to central processing facilities for separation with the oil being recovered as a product and with the gas being either wholly or partially recovered as a product also. In some instances, the gas is redistributed to injection wells and injected; and, in some fields, the water is similarly recovered, passed to injection wells and injected into the formation.

It has been found, when such operations are conducted, especially when corrosion inhibitors are used in the lines leading from the wells to the central processing facility and the like, that, over a period of time, deposits of heavy hydrocarbonaceous materials and finely divided inorganic solids deposit on the inner surfaces of the lines and the separation tanks. These deposits typically comprise finely-divided inorganic particles such as produced solids which may include hydraulic fracturing proppant, formation sand, formation fines and precipitates of materials such as iron sulfide. These particles become coated with corrosion inhibitor or other hydrocarbonaceous materials and subsequently become coated with additional quantities of heavy hydrocarbonaceous material in the flowlines, settling tank and the like. These deposits are referred to herein as "schmoo". The schmoo is a slimy, oily substance which adheres to almost any surface with which it comes in contact, and is difficultly removed from any surface and particularly from the inner surfaces of flowlines, water injection lines into the formation, separation tanks and the like. The material is removable by pigging from flowlines which are of a sufficient size and configuration that pigs can be run through the lines. Such lines are routinely cleaned by pigging. Other lines, such as injection lines into wells, small diameter flowlines, the settling tank surfaces and formation surfaces cannot be reached by pigging operations and, accordingly, the schmoo accumulates in the settling tank on the inner surfaces of these pipe lines, on the surfaces of the well and the like. The separation tanks have typically been cleaned by removing the tank from service, draining the tank and physically cleaning the schmoo from the inner surfaces of the tank. This is a time-consuming, expensive and dangerous operation.

Accordingly, a continuing search has been directed to the development of a method for the removal of such deposits more efficiently and without the need to enter the tank to physically remove the deposits.

SUMMARY OF THE INVENTION

According to the present invention, it has been found that such deposits can be removed from a tank by injecting an aqueous solution containing from about 0.1 to about 20.0 weight percent of an alkyl polyglycoside surfactant selected from alkyl polyglycosides containing alkyl groups containing from about 8 to about 19 carbon atoms and mixtures thereof; from about 0.1 to about 15.0 weight percent of an ethoxylated alcohol selected from the group consisting of ethoxylated alkyl alcohols containing from about 6 to about 16 carbon atoms in the alkyl alcohol and from about 2 to about 6 ethylene oxide groups and mixtures thereof, and ethoxylated alkyl phenols containing from about 8 to about 14 carbon atoms in the alkyl group and from about 2 to about 8 ethylene oxide groups and mixtures thereof, and mixtures of the ethoxylated alkyl alcohols and the ethoxylated alkyl phenols; from about 0.5 to about 30.0 weight percent of a caustic selected from the group consisting of sodium hydroxide, potassium hydroxide, ammonium hydroxide and mixtures thereof; and, from about 0.1 to about 10.0 weight percent of at least one alkyl alcohol containing from about 4 to about 6 carbon atoms into the tank to fill the tank to a selected level; retaining the aqueous surfactant composition in the tank for a selected time period; and, removing at least a major portion of the aqueous surfactant composition containing at least a major portion of the heavy hydrocarbonaceous materials from the tank surfaces below the selected level.

The present invention further comprises a method for cleaning deposits comprising heavy hydrocarbonaceous materials and finely divided inorganic particulate materials from the bottom of a tank, the method consisting essentially of: injecting an aqueous surfactant composition containing from about 0.1 to about 20.0 weight percent of an alkyl polyglycoside surfactant selected from alkyl polyglycosides containing alkyl groups containing from about 9 to about 19 carbon atoms and mixtures thereof; from about 0.1 to about 15.0 weight percent of an ethoxylated alcohol selected from the group consisting of ethoxylated alkyl alcohols containing from about 6 to about 16 carbon atoms in the alkyl alcohol and from about 2 to about 6 ethylene oxide groups and mixtures thereof, and ethoxylated linear alkyl phenols containing from about 8 to about 14 carbon atoms in the alkyl group and from about 2 to about 8 ethylene oxide groups and mixtures thereof, and mixtures of the ethoxylated alkyl alcohols and the ethoxylated alkyl phenols; from about 0.5 to about 30.0 weight percent of a caustic selected from the group consisting of sodium hydroxide, potassium hydroxide, ammonium hydroxide and mixtures thereof; and, from about 0.1 to about 10.0 weight percent of at least one alkyl alcohol containing from about 4 to about 6 carbon atoms through injectors positioned to direct a stream of the aqueous surfactant composition into contact with deposits on the bottom of the tank; dissolving at least a portion of the heavy hydrocarbonaceous material from the deposits on the bottom of the tank; and removing at least a portion of the finely divided particulate materials from the tank in an aqueous stream discharged from the tank.

DESCRIPTION OF PREFERRED EMBODIMENTS

Figure 1:
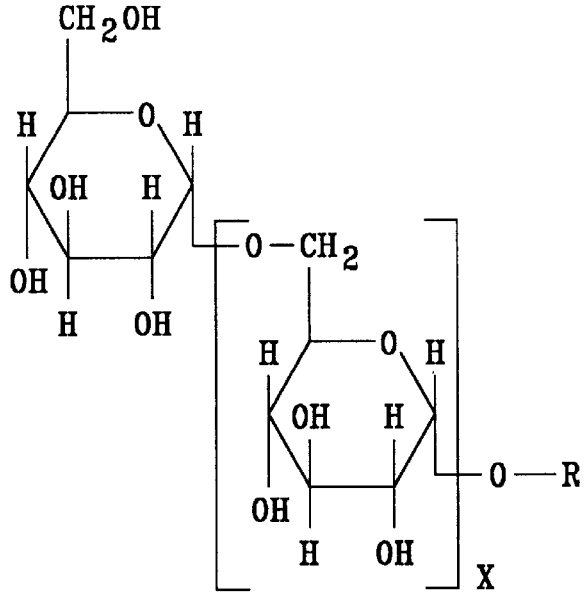
FIG. 1 is a diagram of the molecular structure of an alkyl polyglycoside.

In the discussion of the figures, various pumps, valves and the like necessary to achieve the flows described have not been shown in the interest of conciseness. All concentrations are by weight percent of active ingredient in the aqueous solution unless otherwise stated.

The surfactant composition of the present invention consists essentially of an aqueous solution containing from about 0.1 to about 20.0 weight percent, and preferably from about 0.2 to about 12.0 weight percent, of an alkyl polyglycoside surfactant selected from alkyl polyglycosides containing alkyl groups containing from about 8 to about 19 carbon atoms and mixtures thereof; from about 0.1 to about 15.0 weight percent of an ethoxylated alcohol selected from the group consisting of ethoxylated alkyl alcohols containing from about 6 to about 16 carbon atoms in the alkyl alcohol and from about 2 to about 6 ethylene oxide groups and mixtures thereof, and ethoxylated alkyl phenols containing from about 8 to about 14 carbon atoms in the alkyl group and from about 2 to about 8 ethylene oxide groups and mixtures thereof, and mixtures of the ethoxylated alkyl phenols and the ethoxylated alkyl alcohols; from about 0.5 to about 30.0 weight percent of a caustic selected from the group consisting of sodium hydroxide, potassium hydroxide, ammonium hydroxide and mixtures thereof; and, from about 0.1 to about 10.0 weight percent of at least one alkyl alcohol containing from about 4 to about 6 carbon atoms. Desirably, the alkyl polyglycoside surfactant has a DP number from about 1.30 to about 1.80. The DP number is a measure of the degree of polymerization of the alkyl polyglycoside as defined in *Alkyl Polyglycosides: Technology, Properties and Applications,* edited by Karlheinz Hill, Wolfgang Von Rybinski and Gerhard Stoll, VCH Verlagegesellschaft Mbh, Weinhein (Federal Republic of Germany) and VCH Publishers Inc., New York, N.Y. 1997, pp 11–12.

The alkyl polyglycoside surfactant may comprise a first surfactant consisting essentially of an alkyl polyglycoside selected from the group consisting of alkyl polyglycosides containing alkyl groups containing an odd number of carbon atoms from about 9 to about 13 carbon atoms and mixtures thereof, and having an oligomer distribution from 1 to 12, and a second surfactant consisting essentially of alkyl polyglycosides selected from the group consisting of alkyl polyglycosides containing alkyl groups, a major portion of which are even numbered alkyl groups which contain from about 12 to about 18 carbon atoms and having an oligomer distribution from 1 to 12. Desirably, the alkyl polyglycoside surfactant contains from about 20 to about 90 mole percent of the first surfactant.

The second surfactant may also contain alkyl polyglycosides containing alkyl groups containing odd numbers of carbon atoms from about 9 to about 19 carbon atoms. Either odd-numbered or even-numbered alkyl groups may be used in either the first or the second surfactant as desired to optimize the surfactant properties.

The even numbered alkyl groups are representative of naturally occurring alkyl groups and tend to have a higher pour point and are less convenient to use as surfactants in wellbore operations and the like. Such surfactants are much more viscous and tend to gel at lower temperatures and are otherwise more difficult to handle than the corresponding alkyl polyglycosides containing alkyl groups containing an odd number of carbon atoms. The alkyl groups containing odd numbers of carbon atoms are representative of refinery product streams and are not naturally occurring.

Preferably, the ethoxylated alcohol is present in an amount equal to from about 0.2 to about 8.0 weight percent. The ethoxylated alkyl alcohol may be selected from ethoxylated linear alkyl alcohols, branched alkyl alcohols, Guerbet alcohols, mixtures thereof, and the like. The ethoxylated alkyl phenols may contain linear, branched, Guerbet or a mixture of linear, branched and Guerbet alkyl groups. It is preferred that the ethoxylated alcohol be selected from ethoxylated alkyl alcohols containing from about 8 to about 16 carbon atoms in the alkyl alcohol and from about 2 to about 6 ethylene oxide groups.

The caustic material is desirably present in an amount equal to from about 1.0 to about 22.0 weight percent of the aqueous solution. The caustic is a necessary component of the surfactant composition since it is required in combination with the alkyl polyglycosides and the ethoxylated alcohol to effectively dissolve and remove the deposits.

It is also preferred that the alkyl alcohol be present in an amount equal to from about 0.2 to about 10.0 weight percent. The alkyl alcohol may be a linear or branched alkyl alcohol. The alcohol facilitates mixing and aqueous surfactant composition stability. In the absence of the alcohol, an alkyl polyglycoside surfactant layer and a caustic layer may form in the surfactant composition. While all of the ingredients are present in each layer, they are present in different proportions. With the alkyl alcohol, a homogenous mixture is readily achieved and maintained.

While the surfactant compositions may be used at substantially any temperature between their freezing points and their boiling points, it is preferred that they be used at temperatures above about 120° F. At lower temperatures, longer contact times may be required to remove the schmoo.

It is preferred that the surfactant composition contain a suitable hydrotrope to improve the phase stability of the concentrate and the surfactant composition. The hydrotrope may be a hydrotrope such as monosodium salt of N-lauryl-β-iminodipropionic acid, an alkyl polyglycoside containing linear or branched alkyl groups containing from about 4 to about 8 carbon atoms and the like.

The surfactant composition functions as an alkaline cleaner which solubilizes and disperses the schmoo by suspending it in the surfactant composition. Since the surfactant composition includes a foaming surfactant, it is desirable in many applications to add a suitable quantity of an antifoaming compound such as, for example, a silicon-based antifoam compound. Preferably, the antifoaming additive is added to the aqueous solution containing the caustic before addition of the other materials.

Alkyl polyglycoside surfactants consist of a polar glucose head and an organic carbon chain off of the hemiacetal linkage. A representation of the molecule is shown in FIG. 1. There are two ether oxygens and three hydroxyl groups per glucose unit, plus a terminal hydroxyl group. The lipophilic portion of the molecule resides in the alkyl chain R. R can be a linear or branched alkyl group containing from about 8 to about 18 carbon atoms or a Guerbet alkyl containing from about 9 to about 19 carbon atoms. The polymerization reaction can provide oligomer distributions from 1 to 12 (i.e. x=0 to x=11).

Figure 2:
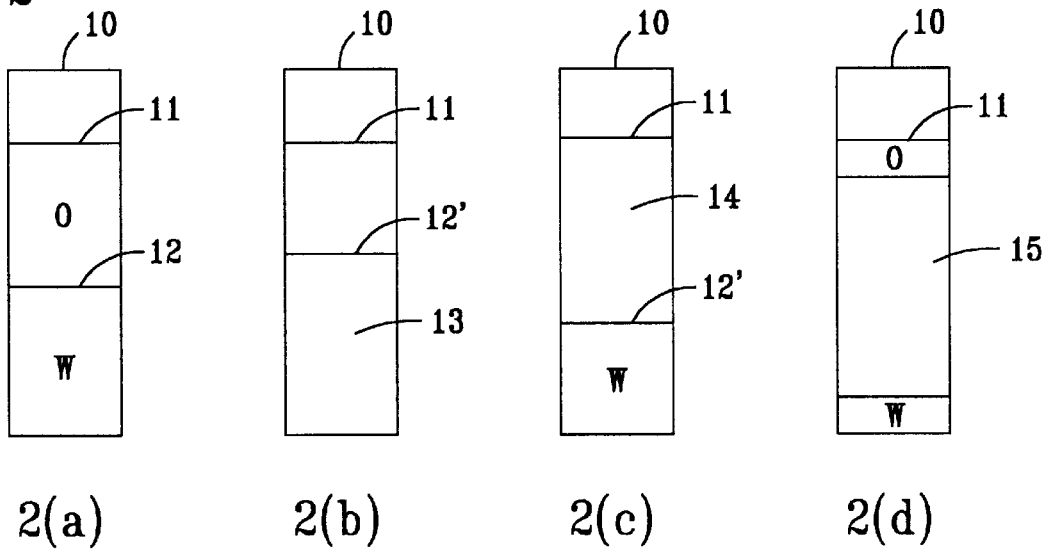
FIG. 2 shows four oil/water systems including Type I, Type II and Type III microemulsions.

In the use of the surfactant composition, it is desirable that the ratio of components be adjusted by testing with the deposits to be removed to form a Type III microemulsion in the wellbore. Such microemulsions are referred to as Windsor Type III or middle phase microemulsions and are described in some detail in "Micellization, Solubilization and Microemulsions", Vol. 2, K. L. Mittal, Plenum Press, New York, 1977. In FIG. 2, Type I, Type II and Type III microemulsions are shown. FIG. 2(*a*) shows oil (o) and water (w) containing surfactants in a container 10 to a level 11 and having an interface 12. In FIG. 2(*b*), a Type I microemulsion 13, which is an oil-in-water microemulsion, is shown below an excess oil layer (o). Such microemulsions are water soluble and contain quantities of solubilized oil, as shown by the level of the new interface 12' which is above the original interface 12. In FIG. 2(*c*), a Type II microemulsion 14, which is a water-in-oil microemulsion, is shown above an excess water layer (w). Such microemulsions are oil soluble and contain quantities of solubilized water as shown by the level of new interface 12' which is below the original interface 12. FIG. 2(*d*) shows a Type III microemulsion 15, which is located between the excess oil (o) and excess water (w) phases and extends above and below original interface 12. Such Type III microemulsions are preferred for pipe and wellbore cleaning operations since their interfacial tensions and solubilization properties toward both oil and water can greatly facilitate the removal of both from wellbores, pipes or other surfaces. Since it is desirable that the deposits be dissolved and removed in the aqueous surfactant, it is desirable that the aqueous surfactant be formulated to produce a Type III microemulsion in the wellbore or pipe. Such microemulsions are much more effective in dissolving hydrocarbonaceous materials in the presence of aqueous solutions than either Type I or Type II microemulsions. It is not necessary that the composition be adjusted to form the desired Type III microemulsion, but it is considered that the surfactant composition is more effective when adjusted to form a Type III microemulsion in the treated area.

Figure 3:
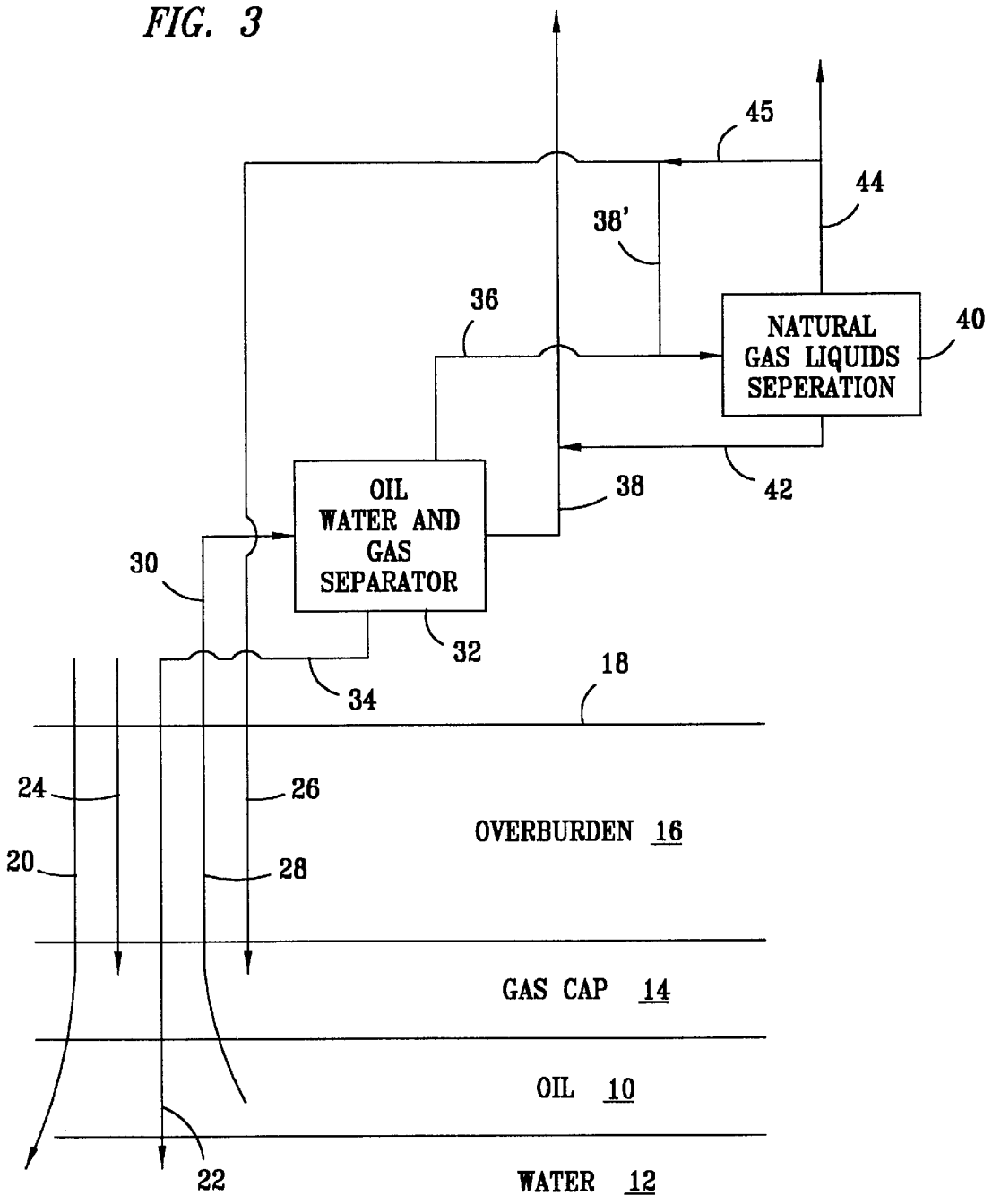
FIG. 3 is a schematic diagram of an oil field operation wherein an oil, gas and water mixture is produced with injection of oil, gas and water.

A typical oil field operation which produces such deposits is shown in FIG. 3. In FIG. 3, an oil-bearing formation 10 is shown positioned above a water-bearing formation 12 and beneath a gas cap 14. Gas cap 14, in turn, is positioned beneath an overburden 16 and beneath a surface 18. Oil, gas and water are produced from oil-bearing formation 10 through a line 30. In the operation of the oil field as shown, sea water may be injected into water-bearing formation 12 as shown by an arrow 20, a miscible gas may be injected into gas cap 14 as shown by arrow 24, and produced water may be injected into water-bearing formation 12 as shown by an arrow 22 with produced gas being optionally introduced into gas cap 14 via a line 26. The produced oil, gas and water stream from oil-bearing formation 10 is passed via a line 30 to an oil, water and gas separator 32. Separator 32 is typically a relatively large vessel to allow a quiescent zone for the gravimetric separation of oil, gas and water. The gas may be recovered, as shown, through a line 38 and passed to a natural gas liquids separation zone 40. In natural gas liquids separation zone 40, natural gas liquids such as butanes, pentanes and the like may be recovered and passed via a line 42 to combination with the crude oil which is separated and recovered from separator 32 via a line 36. The crude oil and natural gas liquids in line 36 are passed to sale or use as a crude oil product. The lighter gases from natural gas liquids separation unit 40 may be passed to use as a natural gas product via a line 44 or, as shown, may be combined, via a line 45, with a portion of the natural gas recovered from separator 32 via a line 38' and passed via line 26 back to injection into the gas cap 14. The produced water is recovered through a line 34 from separator 32 and may be passed with or without further treatment back to water formation 12 via line 22.

The operations above have been discussed very generally since such operations are considered to be well known to those skilled in the art. Deposits of heavy hydrocarbonaceous materials in combination with finely divided inorganic particulates may occur in lines such as line 30 through which the oil, gas and water mixture is passed to separator 32, in line 34 which is a produced water injection line, or in any other lines wherein water is present, such as the tubing in water injection and water and gas injection wells and in the formations in fluid communication with such wells. The deposits are generally believed to comprise a finely divided inorganic particle which may comprise hydraulic fracturing proppant (approximately 1000 microns), formation sand (approximately 100 microns), formation fines (approximately 10 microns) and precipitates such as iron sulfide (approximately 1 micron). These finely divided inorganic solids form a site which may become coated with a corrosion inhibitor or with heavy hydrocarbonaceous materials. These materials are found in crude oil and in many instances are believed to selectively adhere to the inorganic particulate particles. The net result is that these coated particles, referred to herein as "schmoo", adhere to pipe surfaces, separator surfaces, formation surfaces, equipment surfaces and nearly any other surface with which they come in contact. They can accumulate over relatively short periods of time to plug formations, lines and the like. As discussed previously, they also contribute to accelerated corrosion of flowlines, injection lines and the like. The larger particles are separated in the settling tank. The smaller particles such as coated iron sulfide, finely dispersed oil and the like are primary constituents of the schmoo in pipes and other surfaces downstream from the separation tank. As a result, these materials, when dispersed in the surfactant composition, can be passed into the formation.

Figure 4:
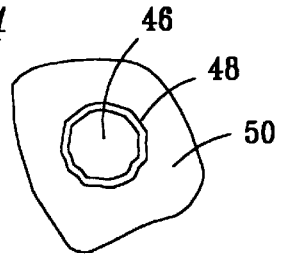
FIG. 4 is a schematic cross-sectional view of a deposit particle containing heavy hydrocarbonaceous materials and a finely divided inorganic particle.
Figure 5:
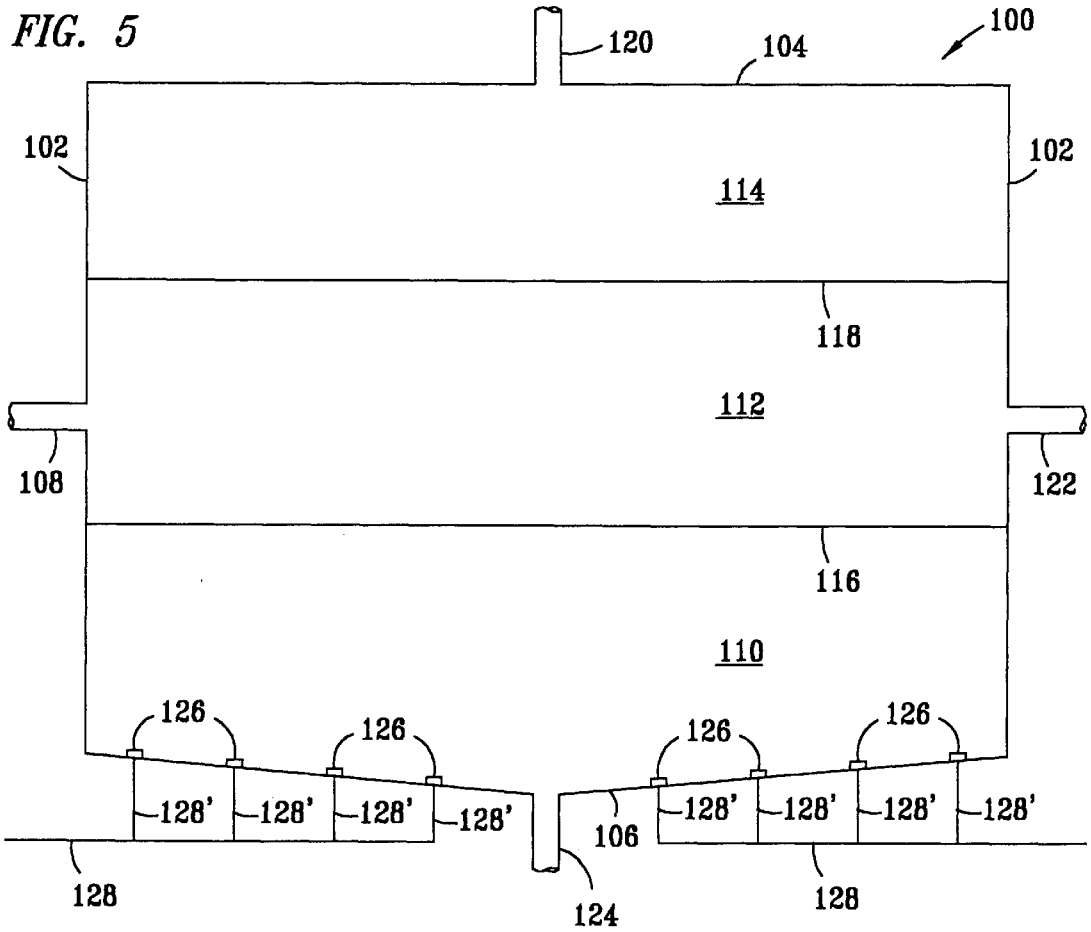
FIG. 5 is a schematic diagram of a separation tank.
Figure 6:
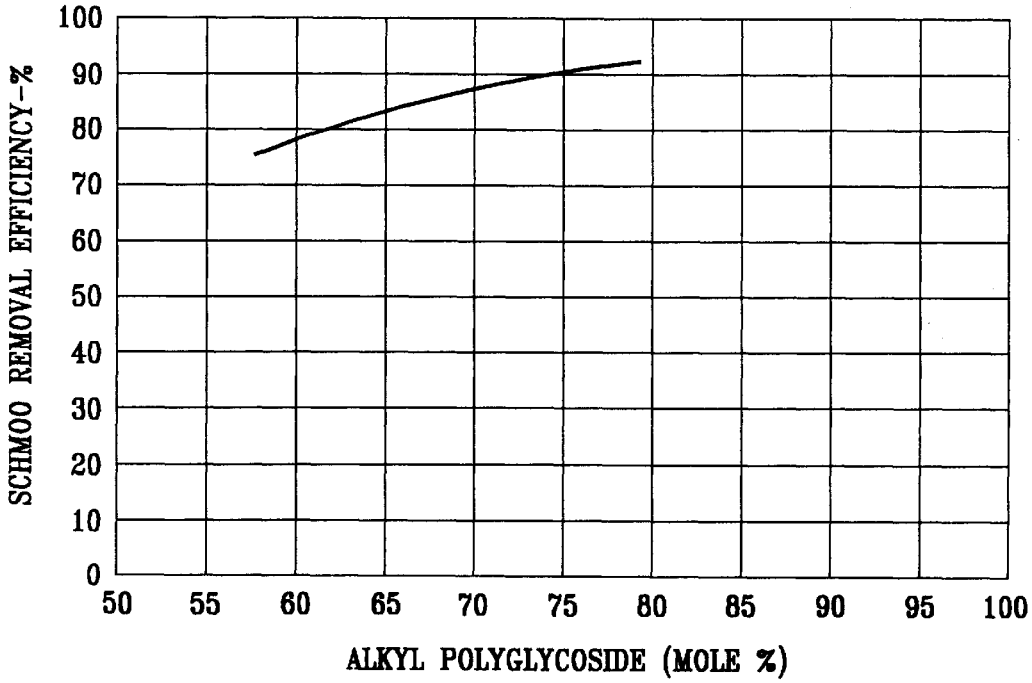
FIG. 6 graphically shows the test results from Example 1.

A schematic of a typical particle of schmoo is shown in FIG. 4. The particle comprises an inorganic solid particle nucleus 46 surrounded by a corrosion inhibitor film 48 and by a layer of oil 50. It is believed that, in the oil/water separation step, the oil, which may be heavier hydrocarbonaceous materials, may be selectively retained on the particles with the lighter hydrocarbonaceous materials floating more readily to the surface for recovery as oil. In any event, a sticky, oily mass of this material is typically produced in oil field operations, is deposited in separation tanks, is readily transported into operating lines, formations and the like, and creates significant operational problems.

EXAMPLE 1

An evaluation of various dispersant formulations was done using a cleaning test. Metal coupons (10 cm×15 cm strips of carbon steel sheet stock) were first weighed. Schmoo was then applied to the coupons, and then the schmoo-coated coupons were baked at 110° F. in an oven. This process was repeated until the schmoo layer was about 6 mm (0.25") thick. The coupons were then reweighed—the difference being the weight of schmoo applied. Each coupon was then submerged in 30 cc of test dispersant held in a 42-cc vial; the coupons were then allowed to soak undisturbed for the prescribed length of time (typically 3 hours). During this soak time, the temperatures of the vials were maintained at 150° F. in an air bath. After the prescribed time, the vials were placed in a rotator (held in a 60° angle from the horizontal plane) and then rotated at 24 rpm for 15 minutes. Rotation of the vials provided a controlled and reproducible amount of agitation to remove any lightly adhering schmoo residue. The coupons were then removed, dried, and reweighed. The difference between the pre- and post-soak weights was the amount of schmoo removed by the dispersant. The amount of schmoo removed divided by the amount of schmoo applied was the "schmoo removal efficiency" for that combination of formulation, soak time, and temperature. Such cleaning tests were performed for various dispersant formulations, with each test series being repeated three times to test reproducibility. When testing different formulations, typically the total weight % of the alkyl polyglycoside (APG)+ethoxylated alcohol (EA) was held constant, and the relative amounts of the two surfactants were varied ($0<APG/(APG+EA)<1$). The results were plotted as the schmoo removal efficiency versus mole % of APG for the dispersant and are shown in FIG. 8. Good schmoo removal was achieved in all tests shown. The dispersant contained 1.5 weight percent of APG and EA, 1.5 weight percent of N-Butanol, and 2.75 weight percent of sodium hydroxide.

The separation tanks are vulnerable to the deposition of schmoo on their inner surfaces, especially the tank bottom and inner surfaces which are contacted with water. In FIG. 8 a separation tank 100 is shown. The separation tank may be a gravity separation tank, a gas flotation cell, a produced oil treater tank or any other vessel used for the separation of gas or oil from water. Separation tank 100 includes sidewalls 102, a top 104 and a bottom 106. A mixture of oil, gas and water is charged to tank 100 via a line 108. Line 108 is positioned at an optimum level to achieve maximum separation of the mixture of oil, gas and water in the separation tank. In tank 100 the oil, gas and water separate into a water layer 110, an oil layer 112 and a gas layer 114. An oil/water interface 116 separates water layer 110 and oil layer 112 and a gas/oil interface 118 separates oil layer 112 and gas layer 114. Gas is recovered from tank 100 via a line 120 with oil being recovered via an oil outlet 122. Water is recovered from the bottom of the tank via a water outlet 124. As shown, the bottom 106 of tank 100 is slightly sloped toward water outlet 124. As well known to those skilled in the art, a plurality of baffles and other devices useful to achieve oil, water and gas separation are normally located in such tank. Such devices include baffles, strategically positioned plates and other devices useful to facilitate the separation of oil, gas and water.

Schmoo is more likely to deposit in bothersome quantities in the lower portion of tank 100 where water layer 110 is located. The schmoo in this area accumulates on the tank walls and the tank bottom. As well-known to those skilled in the art, levels 116 and 118 can vary substantially during the operation of tank 100. Generally the areas which are water-wet are more vulnerable to the deposition of schmoo deposits than the areas of the tank walls which are oil-wet or which are in contact with the gas layer. Since the schmoo containing the heavier and larger inorganic particulates is deposited in the tank, there is a tendency for the schmoo to deposit on the tank bottom.

Previously, such tanks have been cleaned by draining the tank, physically entering the tank and scraping, sandblasting or otherwise removing the schmoo from the tank walls. This is a time-consuming, expensive and dangerous process, since many of the hydrocarbonaceous deposits may release gas slowly or when disturbed.

Accordingly, it is very desirable that a method be found for cleaning such deposits from separation tanks without the necessity for physically shutting down the tank and removing the deposits from the tank walls. According to the present invention, tank 100 is cleaned by draining tank 100 and injecting a solution of the surfactant composition into tank 100. Desirably, the surfactant composition is injected to a level equal to the highest level reached by interface 116. This results in the dispersion of at least a major portion of the hydrocarbonaceous material from the schmoo, thereby releasing the inorganic materials which are free to fall to the tank bottom. Similarly, hydrocarbonaceous material in the schmoo on the tank bottom is dissolved, leaving only the inorganic materials.

If desired, the entire tank may be filled with the surfactant composition to remove hydrocarbonaceous materials such as sludges and the like from all surfaces of the tank.

The inorganic materials which fall to the bottom of tank 100 are readily moved to water outlet 124 by a plurality of injectors, shown as jets 126 which are positioned to agitate and move finely divided solids on the bottom of tank 100 toward water outlet 124. Jets 126, as shown, are supplied with high-pressure fluid through at least one line 128 and a plurality of individual jet fluid supply lines 128'. Jets 126 may be positioned to randomly spray the tank bottom in the vicinity of each jet to agitate and move the finely divided solids, or they may be oriented to direct finely divided solids in a particular direction. Generally the agitation of the finely divided solids, even randomly, results in their gradual movement toward water outlet 124. After the aqueous surfactant composition has been in tank 100 for a sufficient period of time, it is drained through water outlet 124 and removes not only the dissolved heavy hydrocarbonaceous materials, but at least a portion of the finely divided inorganic particulate materials. The aqueous surfactant composition is typically retained in tank 100 for a time period from about 1 to about 4 hours. After draining the aqueous surfactant composition, tank 100 may be returned to normal service. The use of the method of the present invention has resulted in cleaning tank 100 without the need for expensive, tank-invasive procedures and without the need for physically entering the tank to remove deposits from tank walls. The aqueous surfactant solution may be injected through jets 126 to move the inorganic solids toward tank outlet 124. Alternatively, an aqueous solution could be injected through jets 126 if the inorganic solids are free of hydrocarbons. The aqueous surfactant composition may be circulated through the tank by connecting a pump and filter or other solids recovery system to inject the aqueous surfactant compositions into the tank through the jets or otherwise while recovering a solids-containing stream via the tank outlet for solids separation and optional recycle. The circulation may be continued until the solids recovery drops below a selected minimum solids recovery level. The aqueous surfactant composition may be injected into the tank through the jets, other tank inlets or both. Alternatively, aqueous surfactant compositions may be injected into the tank with the outlet stream being passed to treatment and disposal without recycle to the tank. The tank contents, drained from the tank after such a treatment, are generally passed to a slop oil tank for suitable treatment and disposal.

Alternatively, the tank may be treated by injecting the aqueous surfactant composition through jets 126 to remove the schmoo by dispersing the heavy hydrocarbonaceous material from the finely divided particulates. The finely divided solids may then be removed from the tank by recirculation with solids removal from the outlet stream from the tank as discussed above. The tank is emptied to a slop oil tank as discussed above upon completion of the cleanout.

Variations of the jets (injectors) described have not been shown since they are considered to be well-known to those skilled in the art. A variety of tank configurations can be used and a variety of baffles, walls, dividers and the like may facilitate separation of the oil, gas and water. Injectors 126 may be of any suitable type and may be arranged in a variety of configurations.

The aqueous surfactant composition may be agitated in tank 110 if tank 110 includes equipment to agitate the solution, such as equipment to circulate the tank. Agitation is considered to enhance the ability of the aqueous surfactant composition to dislodge finely divided inorganic particulate materials from the tank walls and the like. Tank 110, as shown, does not include an agitation system. The use of the aqueous surfactant composition without agitation is considered to be effective. The method of the present invention can be used effectively in all such tanks.

Preferably, the surfactant composition is injected into tank 100 at a temperature above about 120° F.

The surfactant composition may also include a suitable foam inhibitor if required to prevent excessive foaming in tank 100.

EXAMPLE 2

Water produced in conjunction with petroleum hydrocarbons is treated to remove entrained oil particles to an acceptable level for its final disposition, be it injection into the hydrocarbon reservoir, injection into underground disposal wells, or disposal overboard into the ocean or other water body. Many operations have a specification on the maximum oil-in-water carryover acceptable. One well-known technology used for this purpose is a Gas Floatation Cell (GFC). However, if over a period of time, the capacity of the cell is reduced and its hydraulic flow characteristics impaired by buildup of schmoo, the efficiency of the equipment can be reduced below acceptable levels. At this point, cleaning of the GFC is required to restore its efficiency. Usually this requires taking the unit out of service, and manually removing the solids buildup with mechanical means. This is expensive, a safety hazard for the persons involved, and produces a large quantity of the messy schmoo material which requires the proper type of disposal to mitigate environmental degradation. In this example, an alternate method is described which has advantages over the typical practice.

A standard-design Gas Flotation Cell known to be partially filled with schmoo with a volume of 175 bbl was drained to remove about 115 bbl of produced water and taken off-line and isolated from the process system. The water was at 155 F. A vacuum truck was hooked up to the vessel and 115 bbl of concentrated schmoo dispersant at a temperature of 133 F. injected. The concentrate had a composition of 15% alkyl polyglycoside, 1.5% ethoxylated linear alcohol, 4.5% butanol, 1.5% hexanol, and 16.8% NaOH. The GFC pump was started and the mixture circulated through the GFC for 4 hours. Periodically, the GFC agitators were turned on and allowed to run for about 30–90 seconds and then switched off. If turned on longer, foam in the GFC started to be observed. The agitators rotate at a high rate of speed and provide a high degree of agitation while running. During this process, samples were taken of the circulating fluid and analyzed for solids. The amount of suspended solids in the fluid increased until the sample bottles showed about 30 ml of solids/100 ml of sample. The samples were highly emulsified, as expected, and the solids remained in suspension until the emulsion was purposely broken by adding methanol and xylene. The solids formed were extremely finely divided and appeared "fluffy". After about 4 hours of circulation, the GFC was brought back on-line to the process plant and the fluid was sent to the produced water injection pumps.

The efficiency of the GFC was much improved, the $H_2S$ levels in the GFC off-gas dropped, and the injection wells accepted the fluid containing the dispersant emulsion and solids without any decrease in injectivity. Since the GFC was only off-line for a little over 4 hours, the other three GFC units in this facility were able to temporarily accept the higher rates with very little production impact. No waste was produced. No manual entry into the vessel was needed, avoiding any potential safety problems with confined space hazardous work areas.

Having thus described the present invention by reference to certain of its preferred embodiments, it is pointed out that many variations and modifications are possible within the scope of the present invention. Many such variations and modifications may be considered obvious and desirable by those skilled in the art based upon the foregoing description of preferred embodiments.

We claim:

1. A method for removing deposits comprising heavy hydrocarbonaceous materials and finely divided inorganic particulate materials from a tank, the method consisting essentially of:

a) injecting an aqueous surfactant composition comprising an aqueous solution containing 1) about 0.1 to about 20.0 weight percent of an alkyl polyglycoside surfactant selected from alkyl polyglycosides containing alkyl groups containing from about 9 to about 19 carbon atoms and mixtures thereof;

2) about 0.1 to about 15.0 weight percent of an ethoxylated alcohol selected from the group consisting of ethoxylated alkyl alcohols containing from about 6 to about 16 carbon atoms in the alkyl alcohol and from about 2 to about 6 ethylene oxide groups and mixtures thereof, and ethoxylated alkyl phenols containing from about 8 to about 14 carbon atoms in the alkyl group and from about 2 to about 8 ethylene oxide groups and mixtures thereof, and mixtures of the ethoxylated alkyl alcohols and the ethoxylated alkyl phenols;

3) about 0.5 to about 30.0 weight percent of a caustic selected from the group consisting of sodium hydroxide, potassium hydroxide, ammonium hydroxide and mixtures thereof; and, 4) about 0.1 to about 10.0 weight percent of at least one alkyl alcohol containing from about 4 to about 6 carbon atoms;

into the tank to fill the tank to a selected level;

b) retaining the aqueous surfactant composition in the tank for a selected time period; and, c) removing at least a major portion of the aqueous surfactant composition containing at least a major portion of the heavy hydrocarbonaceous materials from the deposits contacted by the aqueous surfactant composition below the selected level.

2. The method of claim 1 wherein the aqueous surfactant composition is agitated in the tank.

3. The method of claim 1 wherein the tank is used for the separation of hydrocarbonaceous materials and water and wherein the selected level is the highest level reached by water during the separation of the hydrocarbonaceous materials and water.

4. The method of claim 1 wherein at least a major portion of the inorganic particulate materials are removed with the aqueous surfactant composition.

5. The method of claim 1 wherein the selected time period is from about 1 to about 4 hours.

6. The method of claim 1 wherein the tank is a separation tank, a gas flotation tank or a produced oil treater tank.

7. The method of claim 1 wherein the alkyl polyglycoside surfactant comprises a first surfactant consisting essentially of alkyl polyglycosides selected from the group consisting of alkyl polyglycosides containing alkyl groups containing an odd number of carbon atoms from about 9 to about 13 carbon atoms and having an oligomer distribution from 1 to 12 and a second surfactant consisting essentially of alkyl polyglycosides selected from the group consisting of alkyl polyglycosides containing alkyl groups containing from about 12 to about 18 carbon atoms and having an oligomer distribution from 1 to 12.

8. The method of claim 4 wherein the alkyl polyglycoside surfactant contains from about 20 to about 90 mole percent of the first surfactant.

9. The method of claim 4 wherein the second surfactant contains alkyl polyglycosides containing alkyl groups containing odd numbers of carbon atoms.

10. The method of claim 1 wherein the alkyl polyglycoside contains Guerbet alkyl groups containing from 9–19 carbon atoms.

11. The method of claim 1 wherein the ethoxylated alcohol is present in an amount equal to from 0.2 to about 8.0 weight percent.

12. The method of claim 1 wherein the ethoxylated alcohol is selected from the group consisting of ethoxylated alkyl alcohols containing from about 8 to about 16 carbon atoms and from about 2 to about 6 ethylene oxide groups.

13. The method of claim 1 wherein the caustic material is present in an amount equal to from about 1.0 to about 22.0 weight percent.

14. The method of claim 1 wherein the linear alcohol is present in an amount equal to from about 0.2 to about 10.0 weight percent.

15. The method of claim 1 wherein the aqueous surfactant composition is circulated through the tank.

16. The method of claim 15 wherein solids are removed from an outlet stream of aqueous surfactant composition from the tank prior to recycling at least a portion of the aqueous surfactant composition stream.

17. The method of claim 1 wherein the alkyl polyglycoside contains alkyl groups containing even numbers of carbon atoms from 8 to 18 carbon atoms.

18. A method for cleaning deposits comprising heavy hydrocarbonaceous materials and finely divided inorganic particulate materials from the bottom of a tank, the method consisting essentially of:

a) injecting an aqueous surfactant composition containing
   1) about 0.1 to about 20.0 weight percent of an alkyl polyglycoside surfactant selected from alkyl polyglycosides containing alkyl groups containing from about 9 to about 19 carbon atoms and mixtures thereof;
   2) about 0.1 to about 15.0 weight percent of an ethoxylated alcohol selected from the group consisting of ethoxylated alkyl alcohols containing from about 6 to about 16 carbon atoms in the alkyl alcohol and from about 2 to about 6 ethylene oxide groups and mixtures thereof, and ethoxylated alkyl phenols containing from about 8 to about 14 carbon atoms in the alkyl group and from about 2 to about 8 ethylene oxide groups and mixtures thereof, and mixtures of the ethoxylated alkyl alcohols and the ethoxylated alkyl phenols;
   3) about 0.5 to about 30.0 weight percent of a caustic selected from the group consisting of sodium hydroxide, potassium hydroxide, ammonium hydroxide and mixtures thereof; and,
   4) about 0.1 to about 10.0 weight percent of at least one alkyl alcohol containing from about 4 to about 6 carbon atoms, through injectors positioned to direct a stream of the aqueous surfactant composition into contact with deposits on the bottom of the tank;

b) dissolving at least a portion of the heavy hydrocarbonaceous material from the deposits on the bottom of the tank; and, c) removing at least a portion of the finely divided particulate materials from the tank in an aqueous stream discharged from the tank.

19. The method of claim 18 wherein the tank is used for the separation of hydrocarbonaceous materials and water.

20. The method of claim 18 wherein the injectors are positioned to urge the finely divided inorganic particulate material toward an aqueous stream discharge outlet from the tank.

* * * * *